US010427840B2

(12) United States Patent
Van De Klippe et al.

(10) Patent No.: US 10,427,840 B2
(45) Date of Patent: Oct. 1, 2019

(54) PRESS IN FLANGE CONTAINER CLOSURE SYSTEM

(71) Applicant: GREIF INTERNATIONAL HOLDING BV, Vreeland (NL)

(72) Inventors: Cornelis Van De Klippe, West Chicago, IL (US); Steven Talaga, South Elgin, IL (US); Dale Taylor, Hamilton, IN (US)

(73) Assignee: GREIF INTERNATIONAL HOLDING BV, Vreeland (NL)

( * ) Notice: Subject to any disclaimer, the term of this patent is extended or adjusted under 35 U.S.C. 154(b) by 137 days.

(21) Appl. No.: 14/769,684

(22) PCT Filed: Feb. 17, 2014

(86) PCT No.: PCT/EP2014/053049
§ 371 (c)(1),
(2) Date: Aug. 21, 2015

(87) PCT Pub. No.: WO2014/128091
PCT Pub. Date: Aug. 28, 2014

(65) Prior Publication Data

US 2016/0009456 A1 Jan. 14, 2016

Related U.S. Application Data

(60) Provisional application No. 61/768,420, filed on Feb. 23, 2013.

(51) Int. Cl.
*B65D 39/08* (2006.01)
*B65D 39/00* (2006.01)

(52) U.S. Cl.
CPC ..... *B65D 39/084* (2013.01); *B65D 39/0076* (2013.01); *B65D 39/08* (2013.01)

(58) Field of Classification Search
CPC .. B65D 39/084; B65D 39/0076; B65D 39/08; B65D 2251/0012
(Continued)

(56) References Cited

U.S. PATENT DOCUMENTS 3,380,618 A * 4/1968 Phillips ..... B65D 39/084 220/284
4,195,750 A 4/1980 Fee
(Continued)

FOREIGN PATENT DOCUMENTS

CN 1615247 A 5/2005
CN 1630602 A 6/2005
(Continued)

*Primary Examiner* — Anthony D Stashick
*Assistant Examiner* — James M Van Buskirk
(74) *Attorney, Agent, or Firm* — Baker & Hostetler LLP

(57) ABSTRACT

An insert for fitment to a container comprises an internally threaded, through-going opening adapted to receive a complementary, externally threaded plug to form a fluid-tight sealed closure for the container. The insert is preferably of plastics material and comprises an external recessed portion or groove shaped to snap-fittingly retain the insert installed in an aperture formed in the container. The aperture preferably comprises an upstanding collar snap-fitted into the groove for favorable installation, compression and energization of a sealing washer.

18 Claims, 4 Drawing Sheets

(58) Field of Classification Search
USPC ..... 220/327, 254.8, 304
See application file for complete search history.

(56) References Cited

U.S. PATENT DOCUMENTS

| | | | | |
|---|---|---|---|---|
| 4,588,103 | A | 5/1986 | Baughman | |
| 5,853,100 | A | 12/1998 | Kars | |
| 5,971,189 | A * | 10/1999 | Baughman | B65D 39/084 220/288 |
| RE38,271 | E | 10/2003 | Kars | |
| 7,168,585 | B2 * | 1/2007 | Baughman | B65D 7/40 220/254.8 |
| 2003/0132244 | A1 | 7/2003 | Birkmayer et al. | |

FOREIGN PATENT DOCUMENTS

| | | | |
|---|---|---|---|
| GB | 992 182 | A | 5/1965 |
| GB | 1 032 701 | A | 6/1966 |
| GB | 1392603 | A | 4/1975 |
| WO | 00/46115 | A1 | 8/2000 |
| WO | 03/066460 | A1 | 8/2003 |

* cited by examiner

Fig. 9
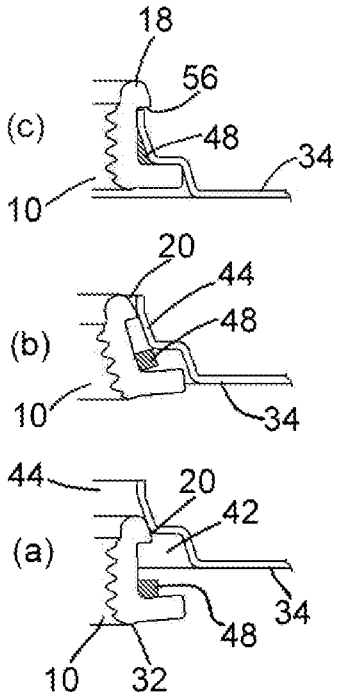
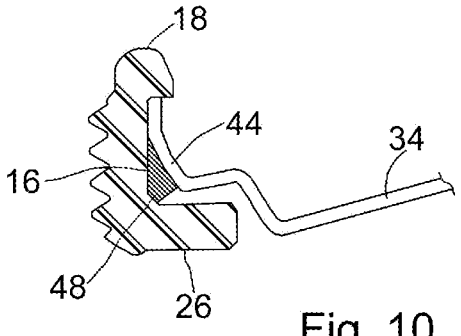
Fig. 10

PRESS IN FLANGE CONTAINER CLOSURE SYSTEM

CROSS-REFERENCE TO RELATED APPLICATIONS

This application is a National Stage of International patent application PCT/EP2014/053049, filed on Feb. 17, 2014, which claims priority to U.S. provisional patent application No. 61/768,420, filed on Feb. 23, 2013, the disclosures of which are incorporated by reference in their entirety.

FIELD OF THE INVENTION

This invention relates to an internally threaded insert used to receive a complementary threaded plug to form a fluid-tight sealed closure for a container. Typically such inserts are used to form part of a "closure set" for a container formed from sheet metal, such as a steel drum; the other components of the closure set being the threaded plug, and usually one or more sealing washers. Such threaded inserts are known in the art as "flanges". For simplicity, portions of the following description refer to closure plug-receiving threaded inserts used in steel drums. However inserts according to the invention may be used in any suitable container.

BACKGROUND OF THE INVENTION

Inserts of the above kind for steel drums conventionally have also been made of steel, for reception of a pressed steel plug. A thread is rolled on the outside of the plug, for co-operation with the insert internal thread. The insert is typically fitted to a drum as follows. The drum maker forms a drum head with an aperture surrounded by an upset, outwardly projecting collar. The insert is inserted through the collar and has a radially outwardly projecting flange at its inner end which butts up against the inside of the drum head. In this position, a tubular outer end of the insert projects outwardly beyond the drum head collar. The projecting tubular outer end is then curled outwardly and downwardly around the circumference of the collar, so as to trap the insert permanently in position. Prior to insertion, one or more sealing washers are slipped over the insert so as to rest against the radially projecting flange. During the curling operation, these washers are forced into the gap between the insert and collar, to form a permanent, fluid-tight seal. At the filling line, after the drum has been filled, the plug, equipped with another suitable sealing washer, is screwed into the insert to seal in the contents. The end user may then unscrew and reclose the closure plug as often as they need to.

For contents which are corrosive or sensitive to contamination (e.g. medical or food grade products, or paints) the drum interior, insert and plug must be suitably lacquered to prevent such corrosion or contamination. With repeated removal/replacement of the plug, the lacquer, particularly in the thread area of the plug and insert, can become damaged, exposing the container contents to bare metal and hence causing corrosion/contents contamination problems. With volatile contents, all-metal drums, inserts and closure plugs pose a risk of explosion if the drum is exposed to very high temperatures, e.g. in a fire. Plastics closure plugs are prescribed for use in these situations. They will melt to provide pressure relief in case of fire, and are corrosion resistant. Plastics materials are also available in food/medical grades. But they do not solve the problem of exposed metal on a worn or damaged insert. Nor is there any guarantee that the drum filler and (to a greater extent) the end user, will not incorrectly replace the plastics plug with a metal one. These problems are mitigated by providing a plug-receiving threaded insert made from plastics material. This will fuse in the event of fire and can be made inherently corrosion resistant/non-contaminating, in the same way as a plastics plug. As the insert is permanently installed in the drum, it cannot readily be replaced with a component of the incorrect type. Special threadforms can be used (e.g. a buttress thread) to ensure compatibility only with plastics plugs. On the other hand there is design freedom to provide generic threadforms compatible with either plastics or metal plugs, where universal use/reduced parts inventories are a customer requirement.

U.S. Pat. No. 4,195,750 (Fee) and U.S. Pat. No. 4,588,103 (Baughman) disclose an internally threaded plastics insert ("flange") used to receive a complementary threaded plug which forms a fluid-tight sealed closure for a container. An upstanding boss surrounding an opening is formed from the sheet metal of the container wall. The plastics insert is fitted into the boss from inside the container, with a portion of the boss overlying at least an upper face of the insert. The boss is then crimped around the insert to engage serrations and a circumferential groove formed around the outside of the insert, to retain the insert non-rotatably in the container opening. A plug may then be screwed into the insert, with a sealing washer which engages the portion of the boss overlying the insert upper face. Therefore no further sealing washer is required between the insert and the material of the container. A resilient washer may be provided between a flange on the inner end of the insert and the adjacent container sheet material surrounding the boss; but the primary purpose of this washer is to trap any debris (e.g. lacquer flakes) dislodged during the crimping operation and prevent it from falling into the container. Although the disclosed plastics insert has several advantages, it requires relatively complex specialist tooling to form the boss and perform the crimping operation. An exposed edge of the container sheet metal can remain accessible by the container contents via the plug/insert threads. If the crimp process is not properly controlled or tooling wears down or the material of the flange creeps over time, then the insert can rotate in the drum causing a serious issue which is typically not discovered until the drum is filled and the plugs are final torqued, or during removal of the plug by the end user. A more conservative plastics insert design, which in some aspects is closer to well-proven and reliable metal insert designs and which is easy for the drum maker to fit, is therefore desirable.

SUMMARY OF THE INVENTION

Accordingly, the present invention provides an insert for fitment to a container;

the insert comprising an internally threaded, through-going opening adapted to receive a complementary, externally threaded plug to form a fluid-tight sealed closure for the container;

the insert comprising an external recessed portion shaped to snap-fittingly retain the insert installed in an aperture formed in the container. The snap-fit installation of the insert in the aperture is readily achieved using press tooling of the kind already in use by most drum makers.

Preferably at least one of the insert or a container wall in which the aperture is formed (most preferably the insert) is made from plastics material. This provides sufficient resiliency to easily allow a snap fit which firmly retains the insert in the aperture. Particularly good retention is achieved where one of the insert and container wall is of plastics material, and the other (preferably the container wall) is of a stiffer material, such as metal. The insert of the present invention is therefore particularly advantageous for use in sheet metal containers such as pails, cans and drums.

Preferably the external recessed portion comprises a circumferential groove. This may serve to retain a sealing element such as a sealing washer used to ensure a fluid-tight seal of the insert in the container aperture.

Preferably the circumferential groove comprises a cross-section that is elongated in the axial direction of the insert thread. Such a groove may receive an edge portion of the container aperture which is formed as an upstanding collar. The groove and collar may therefore define between them a gland area for reception of an annular sealing element, such as a sealing washer.

The insert may comprise an end formed with a rounded or tapered rim which provides a guide surface for leading the insert through the container aperture under compression. Conveniently the rim may comprise a rearwardly facing shoulder which advantageously forms a forward end wall of the external recessed portion. The rim may also comprise a seating surface positioned for co-operation with a seal provided on the plug.

The insert may further comprise an end opposite the rim, comprising a resilient radial projection, such as a flange, preferably having a forwardly facing surface which forms a rearward end wall of the external recessed portion. The projection is engageable with a surface of the container to prevent ejection of the insert from the container aperture.

Where the resilient radial projection is a flange, it preferably comprises a non-round (e.g. polygonal) outer edge engageable in a complementarily shaped recess formed in a container wall portion surrounding the aperture. In use, the flange will therefore co-operate with the recess to lock the insert in the aperture in a non-rotatable manner, allowing the plug to be torqued into and out of sealed engagement with the insert, against a reaction torque provided by the container wall portion recess. An annular boss may be provided at the base of the flange, for engagement with an insertion press tool.

The projection forwardly facing surface preferably extends forwardly and outwardly so that the projection may be resiliently deformed and pre-loaded against a surface (e.g. an inner surface) of the container wall portion, when the insert is snap-fitted into place. Such deformation also allows for "over-insertion" of the insert through the aperture, to allow the rearwardly facing shoulder of the insert rim to clear the aperture and form the snap-fit, even when the aperture is somewhat oversized in the insertion direction. The deformation is preferably also sufficient to generate a final pre-load even when the aperture is somewhat undersized in the insertion direction.

The present invention also provides an insert as described above, in combination with an annular sealing element received in the external recessed portion, for forming a peripheral, fluid-tight seal with the container aperture. The combination may further comprise an externally threaded plug, threadingly receivable in the insert opening.

The present invention yet further provides, in combination:

an insert comprising an internally threaded, through-going opening adapted to receive a complementary, externally threaded plug to form a fluid-tight sealed closure;

a container wall having an aperture therein, the insert comprising an external circumferential groove which snap-fittingly retains the insert installed in the aperture; and an annular sealing element received in the circumferential groove so as to form a peripheral, fluid-tight seal between the insert and the aperture.

The circumferential groove preferably comprises a cross-section that is elongated in the axial direction of the insert thread;

an edge portion of the container aperture which is formed as an upstanding collar being received in the groove, thereby defining between the collar and the groove a gland area within which the annular sealing element is received.

The insert may comprise an end formed with a rounded or tapered rim which provides a guide surface for leading the insert through the collar under compression while it is being installed in the aperture, whereby the insert and/or the collar is/are resiliently deformed and the sealing element is carried by the circumferential groove into the collar with no or reduced compression;

the rim comprising a rearwardly facing shoulder which preferably forms a forward end wall of circumferential groove and behind which the collar snaps when the insert is fully installed; the insert and/or the collar thereby resiliently recovering and compressing the sealing element in the gland area. Because the sealing element is carried into the container wall collar under reduced compression or substantially uncompressed, it is reliably deeply seated in the gland area when the insert is fully installed. That is, the sealing element does not have to be forced into the gland area against substantial compression forces. The sealing element is only fully compressed and energised once the collar snaps into place behind the forward end wall of the circumferential groove. The resulting reliable deep penetration of the sealing element into the gland area ensures that the sealing element remains held compressed and energised around its entire circumference to ensure a leak-free seal, even when the container wall has been bent out of shape, e.g. through the container having been dropped or otherwise struck or roughly handled.

The upstanding collar preferably tapers so as to narrow in a direction along which the insert is installed.

Thus the present invention correspondingly provides a method of snap-fittingly installing an insert in an aperture in a container wall, the insert comprising an external circumferential groove; an internally threaded, through-going opening adapted to receive a complementary, externally threaded plug to form a fluid-tight sealed closure; and an end forming a rounded or tapered rim which provides:

(i) a guide surface and (ii) a rearwardly facing shoulder;

an edge portion of the container aperture being formed as an upstanding collar;

the method comprising the steps of:

installing a sealing element in the circumferential groove;

pressing the insert into the collar so that the guide surface resiliently deforms the insert and/or the collar and the sealing element is carried into the collar under reduced or no compression, and further pressing the insert into the collar so as to allow a forward end of the collar to snap fit into place behind the rearwardly facing shoulder;

the insert and/or the collar thereby resiliently recovering so as to compress the sealing element between the circumferential groove and the upstanding collar.

The method may comprise:

pressing the insert into the collar until a clearance is developed between the forward end of the collar and the rearwardly facing shoulder; the insert further comprising a resilient portion which is deformed and pre-loaded against a surface of the container wall as the insert is pressed into the collar, and ceasing to press the insert into the collar, whereupon the resilient portion pulls the forward end of the collar into engagement with the rearwardly facing shoulder.

Further aspects, preferred features and advantages of the invention are described below with reference to an illustrative embodiment shown in the drawings.

BRIEF DESCRIPTION OF THE DRAWINGS

FIG. 9 shows sequential views diagrammatically illustrating the insert and sealing washer installation process;

FIG. 10 diagrammatically illustrates sealing washer retention in the event that the drum head is bent out of shape;

DETAILED DESCRIPTION OF THE PREFERRED EMBODIMENTS

Figure 1:
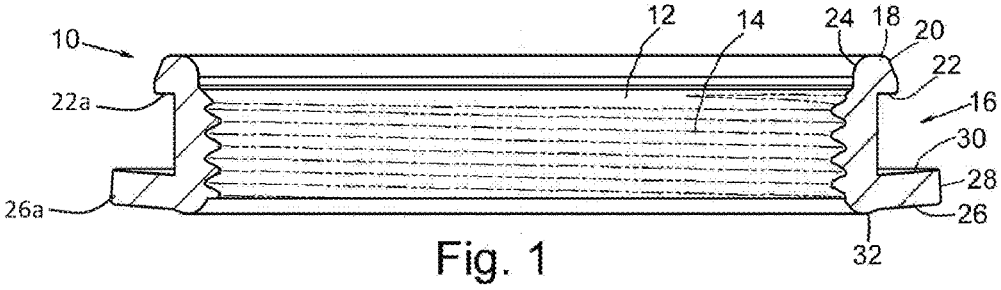
FIG. 1 is a cross-sectional view of an insert embodying the present invention taken on line I-I in FIG. 2.
Figure 2:
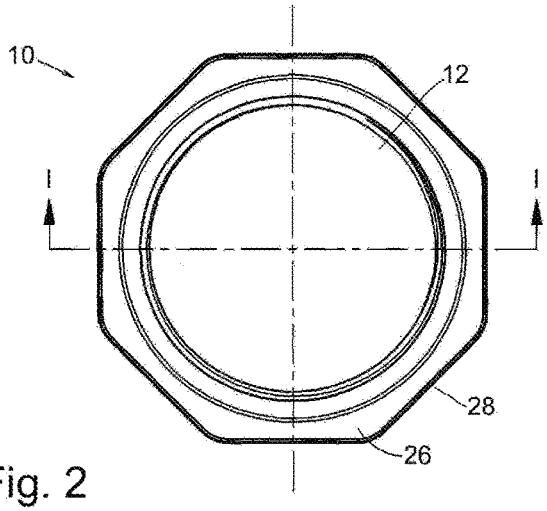
FIGS. 2, 3, and 4 are respectively plan, side and underplan views of the insert of FIG. 1.
Figure 3:
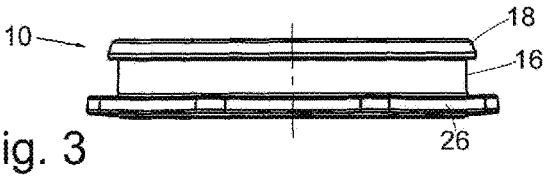
Figure 4:
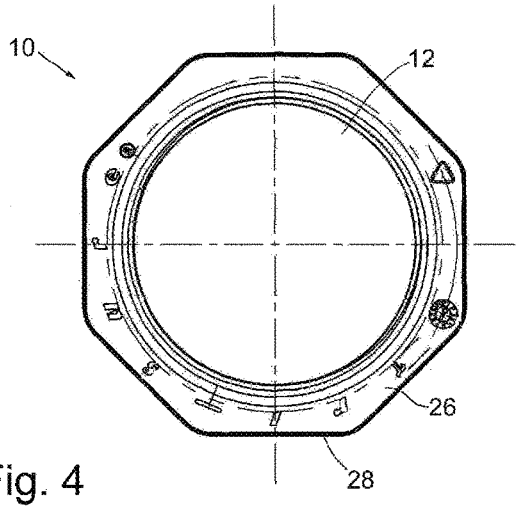

Referring to FIGS. 1-4, the insert 10 for fitment to a container comprises a one-piece injection moulded body formed from plastics material, chosen inter alia for compatibility with the container contents. For example, in the case of food products, the material could be FDA approved, 30% w/w glass fibre filled PA66 nylon; the glass fibre conferring stability against creep and thermal expansion/shrinkage. Other plastics materials can be used to confer resistance to particular solvents or chemical attack. The insert includes a through- going opening 12 with an internal, 11 TPI parallel BSP thread 14 for reception of a standard two inch (approximately 51 mm) externally threaded closure plug (not shown in these Figures). The insert may be of any suitable size, e.g. for reception of other standard sized container closure plugs: ¾ inch (approximately 19 mm), 40 mm, etc. Similarly, any suitable threadform may be used for the insert, to match that of the plug. A side wall of the insert 10 is provided with an external recessed portion in the form of a circumferential groove 16, by which the insert is snap-fittingly installed in an aperture formed in a drum head or other container wall, as further described below.

One end of the insert is formed with a rounded rim 18 which provides a tapered guide surface 20 for leading the insert through the container aperture under compression. The rim also comprises a rearwardly facing shoulder 22 which forms a forward end wall **22*a* of the external recessed portion or circumferential groove 16. The rim also provides an inwardly curving seating surface 24** for a sealing washer provided on the plug (not shown in these Figures).

At its end opposite to the rim 18, the insert comprises a radial projection **26*a* in the form of a flange 26 with an octagonal outer edge 28. A forwardly facing surface 30 of the flange 26 forms a rearward end wall of the external recessed portion or circumferential groove 16. The surface 30 extends forwardly and outwardly as shown, so that the flange 26 is slightly dished in the forward direction. An annular boss is 32 provided at the base of the flange 26**, for engagement with an insertion press tool (not shown).

Figure 5:
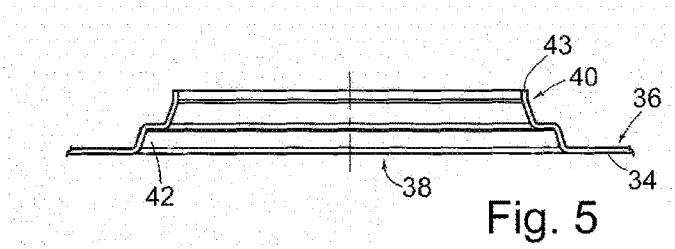
FIG. 5 shows, in cross-section, part of a metal drum head formed with an aperture and a surrounding upstanding collar into which the insert of FIG. 1 is to be snap-fittingly installed.
Figure 6:
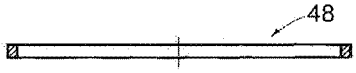
FIG. 6 shows, in cross-section, a sealing washer for use with the insert and drum head of the preceding Figures.
Figure 7:
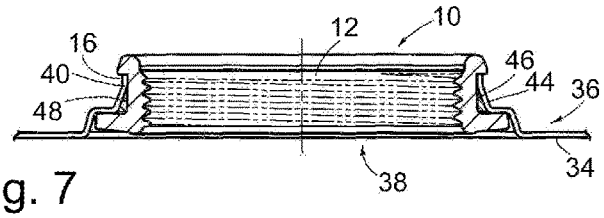
FIG. 7 is a cross-sectional view showing the insert and sealing washer installed in the aperture.

Referring now to FIGS. 5-7, a wall 34 of a container 36 (such as the head of a steel drum) is formed with an aperture 38 having an edge portion upset to form an upstanding collar 40. A recess 42 is pressed into a portion of the container wall surrounding the aperture 38, at the base of the collar 40. The recess is of a complementary size and of octagonal shape in plan, so as to snugly receive the insert flange 26 when the insert 10 is installed in the aperture 38, as shown in FIG. 7. The circumferential groove 16 of the insert 10 has a cross-section that is elongated in the axial direction of the insert thread 14. The upstanding collar 40 surrounding the aperture 38 is snap-fittingly received in the groove 16 so as to be trapped between the shoulder 22 and the flange surface 30. The height of the upstanding collar from the bottom of the recess 42 to the forward edge 43 of the collar is slightly smaller (e.g. 0.008 inches, 0.2 mm, less) than the axial distance between the shoulder 22 and the outer edge of the flange forwardly facing surface 30 when the flange 26 is in its initial, relaxed, dished shape. Upon installation of the insert 10 in the aperture 38, the flange is therefore slightly flattened from this initial shape, and so is resiliently pre-loaded against the collar 40, to grip the collar between the shoulder 22 and the flange surface 30 outer edge. The complementary octagonal shapes of the flange 26 and recess 42 ensure that the installed insert 10 cannot rotate in the aperture 38. The base part 44 of the upstanding collar tapers in the forward (insert insertion) direction so that the groove 16 and collar 40 define between them a gland area 46 of substantially triangular cross-section, for reception of an annular sealing element, such as sealing washer 48. As shown in FIG. 6, the sealing washer 48 may be cut from a length of tubular material so as to have a rectangular cross-section when relaxed. However, other cross-sectional shapes are also possible, e.g. moulded sealing rings, gaskets or O-rings. In use, the sealing washer is compressed to occupy substantially the entire triangular cross-section of the gland area 46. The sealing washer may be made of any suitable material, e.g. EPDM, black nitrile rubber, or polythene, as is conventional.

Figure 8:
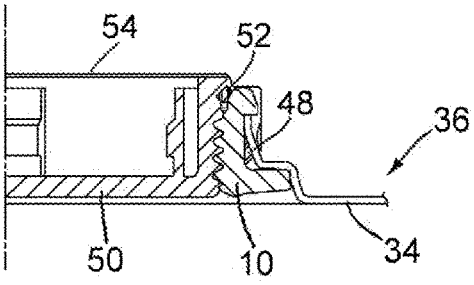
FIG. 8 is a half cross-section corresponding to FIG. 7, but showing a closure plug and overcap installed in and over the insert respectively.

FIG. 8 shows a plastics plug 50 screwed into the opening 12 in the insert 10 to form a fluid-tight seal to the container 36. The plug 50 carries a sealing washer 52 which, with the plug fully torqued into the opening 12, seals against the seating surface 24 on the insert rim 18. A conventional metal overseal 54 can be applied to the resulting assembly, with its edges crimped into the groove 16, overlying the collar 40.

The rim 18 overhangs the forward end 42 of the collar 40, to provide an outward radial projection for retaining the crimped overseal 54.

FIG. 9 shows the insert installation process. In panel (a), the insert 10 is shown offered up to the aperture 38 through the octagonal recess 42, so that the tapered guide surface 20 of the rim 18 engages in the mouth of the collar tapered portion 44. The sealing washer 48 has been installed in the circumferential groove 16 adjacent to the flange 26, by stretching it to pass over the rim 18. A press tool is placed against the boss 32 to drive the insert 10 further into the collar 40.

As shown in panel (b), as the guide surface 20 moves along inside the tapered portion 44 of the collar 40, a wedging action takes place which compresses the rim 18 and distorts the groove 16. The radial width of the shoulder 22 is of the same order as the radial width of the sealing washer 48 and so as the insert 10 is driven further into the collar 40, the inner wall of the groove 16 distorts to become roughly parallel to the tapered inner wall of the collar portion 44. The collar 40 is also expanded somewhat; but being of a stiffer material (typically steel), the amount of distortion is significantly less than the distortion of the plastics insert 10, despite the thinner section of the collar 40 compared to the insert wall cross-section.

The sealing washer 48, being stretched onto the insert 10, continues to hug the groove 16 and distorts with it. The compressive distortion of the insert 10 and its groove 16, and the fact that the base of the groove 16 remains spaced from the inner surface of the collar 40 by the width of the shoulder 22, opens up a space which allows the sealing washer 48 to move into the tapered portion 44 of the collar, substantially without any compression. The sealing washer 48 is therefore reliably carried deeply into the collar 40 as the insert 10 is pressed into the aperture 38.

When the forward edge 43 of the collar 40 draws level with the shoulder 22 so that the rim 18 is no longer held in compression, the rim snaps outwards and the shoulder 22 engages in front of the collar forward edge 43; as shown in panel (c) of FIG. 9. The radial width of the shoulder 22 is also roughly equal to the end-to-end radial taper of the collar 40. Therefore the gap between the inner wall of the groove 16 and the inner wall of the collar 40 reduces to become the triangular sectioned gland area 46, with the collar forward edge 43 resting on or close to the groove 16 inner wall when the rim 18 has snapped outwards. The sealing washer 48 is therefore tightly compressed and energized to form a reliable, fluid-tight seal between the drum head 34 and the insert 10. The amount of distortion of the insert 10 and of the collar 40 is preferably kept within their respective elastic limits, so that they will each return substantially to their original shapes after being snap-fittingly interengaged.

The press tool is used to drive the insert 10 further into the aperture 38 until the dished flange 26 becomes flattened against the bottom of the octagonal recess 42. In this position, as shown in panel (c), a small gap 56 opens up between the shoulder 22 and the collar forward edge 43. This gap ensures that the insert 10 will snap reliably into the aperture 38, even if the aperture is oversized, i.e. if the height of the collar 40 is somewhat larger than the nominal size. The axial depth of dishing of the flange 26 forward surface 30 is made larger than the nominal width of the gap 56, so that the insert is pulled in a direction opposite to the insertion direction as the insertion press tool is withdrawn and the flange springs back towards its dished shape. This ensures that the gap 56 is then eliminated and a residual preload remains between the flange and the base of the recess and between the shoulder 22 and the collar forward edge 43, so that the collar 40 is firmly gripped in the insert groove 16. This is preferably the case even if the aperture is somewhat undersized, i.e. when the height of the collar 40 is somewhat less than nominal. The collar may be radially crimped post-insertion, to further energise the sealing washer 48 in the gland area 46, if required.

FIG. 10 diagrammatically shows what happens if the drum head 34 is bent out of shape, e.g. by a heavy accidental blow to one side of the insert rim 18. Because the sealing washer 48 is reliably driven deep into the gland area 46, an upper edge of the sealing washer remains pinched between the inner wall of the insert groove 16 and the adjacent inner wall of the collar tapered portion 44. The sealing washer 48 is therefore retained within the gland area 46 and energized around the full circumference of the insert 10, to maintain a reliable seal. That is, the sealing washer is not extruded from the gland area in the region where the drum head 34 is bent inwardly.

Figure 11:
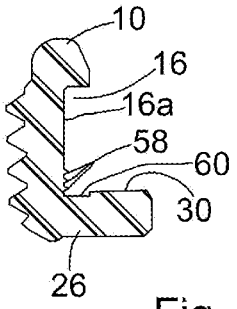
FIG. 11 is a diagrammatic representation of an insert profile with different sealing washer engaging features which may be used together or separately in various further embodiments of the invention.

To provide enhanced sealing between the sealing washer 48 and the insert 10, the inner wall surface 16*a* of the insert groove 16 may be provided with circumferential sealing ribs 58, as shown in FIG. 11. These act to concentrate the stress applied to the sealing washer 48 in their locality. This assists in achieving and maintaining a seal between the sealing washer and the insert groove inner wall surface 16*a*; particularly if there is plastic deformation of the insert 10 during insertion, or creep of the insert and/or sealing washer over the longer term. All of these events could tend to reduce the residual compressive force in the sealing washer 48 in the gland area 46. The ribs 58 therefore assist in maintaining a localised, high energizing pressure, sufficient to provide a good fluid tight seal. The ribs 58 can also assist in carrying the sealing washer 48 into the collar 40 as the insert 10 is pressed into the aperture 38, by increasing the frictional resistance to relative sliding movement of the sealing washer along the groove inner wall surface 16*a*.

FIG. 11 also shows a circumferential groove or relieved area 60 provided in the forwardly facing surface 30 of the flange 26, in the root area of the flange 26 adjacent to the groove inner wall surface 16*a*. The relieved area 60 is of substantially rectangular cross-section and of an appropriate size to receive and retain the bottom part of the sealing washer 48 and hold it captive in the radial direction; again assisting in ensuring that the sealing washer is biased forwardly into the upstanding collar 40. The relieved area 60 may have other cross-sectional shapes complementary to the shape of the corresponding bottom part of the sealing washer 48, if this is non-rectangular. The relieved area 60 and ribs 58 are each optional, and may be used together or independently of each other.

Figure 12:
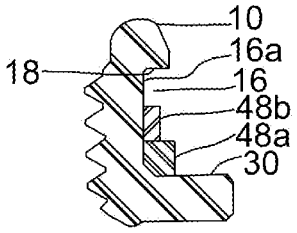
FIG. 12 is a diagrammatic view showing a possible alternative sealing washer assembly for use in embodiments of the present invention.
Figure 13:
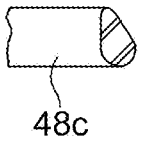
FIG. 13 is a partial cross-sectional view of yet another sealing washer that may be used in embodiments of the invention.

FIG. 12 shows a sealing washer assembly formed from two separate parts, 48*a* and 48*b*. Each part 48*a*, 48*b* consists of a rectangular sectioned, annular washer, of nominally equal internal diameter to each other. The rearward washer 48*a* in the assembly, i.e. the one immediately adjacent to the flange forwardly facing surface 30, is of larger external diameter than the other, forward washer 48*b*. Small diameter washer 48*a* can therefore easily enter the gap between the groove inner wall surface 16*a* and the inner wall of the collar tapered portion 44, which gap is opened up by compression of the insert 10 as it is pressed into the aperture 38. The larger diameter washer 48*a*, even if it completely spans this gap, will still tend to be forced at least partially into the gap, with its forward end acting as a "piston" to force the smaller diameter washer deeper into the gap. When the shoulder 22 snaps behind the forward edge 43 of the collar 40, the larger diameter washer 48*a* is radially compressed, which causes it to expand longitudinally. As the washer 48*a* is trapped in the gap by the flange 26, its longitudinal expansion will drive the smaller diameter washer 48*b* even deeper into the gap, i.e. deeper into the gland area 46. This enhances the ability of the washer 48*b* to be pinched and trapped between the insert groove inner wall 16*a* and the collar tapered portion 44, and remain trapped in this way even when the drum head is bent out of shape as shown in FIG. 10. Further details of such a washer assembly and its installation and operation are disclosed in US RE38271E, the entire disclosure of which is incorporated herein by reference. The washer assembly may comprise two or more distinct and separate parts, or two or more initially separate parts bonded or otherwise joined together in axial series. Yet alternatively, the various parts may comprise regions of a single body, e.g. a one-piece moulding. An example of an annular seal 48*c* having such a body formed in one piece to provide a canted teardrop shaped cross-section is shown in FIG. 13.

The invention claimed is:

1. A kit of parts of a container, comprising:

(a) a container component comprising an aperture having a predetermined diameter when in an undistorted state;

(b) an annular sealing element with a radial thickness, and (c) an insert for installation in the aperture, the insert comprising:

an internally threaded, through-going opening adapted to receive a complementary, externally threaded plug to form a fluid-tight sealed closure for the container;

a circumferential groove serving to receive the sealing element, the circumferential groove having a radially outwardly facing base surface;

an end which, prior to installation of the insert in the container aperture, is formed with:

(i) a tapered rim which provides a guide surface for leading the insert through the container aperture under compression, and (ii) a rearwardly facing shoulder already shaped to snap-fittingly retain the insert in the container aperture when later installed therein;

wherein the tapered rim of the insert in an undistorted state is of larger outer diameter than the predetermined diameter of the aperture of the container component; the rim being compressible to be equal in diameter to the diameter of the aperture during installation of the insert therein, and which compression distorts the groove so as to open up a space between the groove and the container opening until the rearwardly facing shoulder snap-fittingly retains the insert installed in the container aperture.

2. The kit of parts defined in claim 1, in which at least one of the insert or a wall of the container in which the aperture is formed, is made from plastics material.

3. The kit of parts defined in claim 1, in which the circumferential groove comprises a cross-section that is elongated in the axial direction of the insert thread.

4. The kit of parts defined in claim 1, in which the rearwardly facing shoulder forms a forward end wall of the circumferential groove.

5. The kit of parts defined in claim 1, in which the rim comprises a seating surface positioned for co-operation with a seal provided on the plug.

6. The kit of parts defined in claim 1, in which the insert further comprises an end opposite the rim, comprising a resilient radial projection.

7. The kit of parts defined in claim 6, in which the projection has a surface facing forwardly in the insertion direction and which forms a rearward end wall of the circumferential groove.

8. The kit of parts defined in claim 6, in which the projection is engageable with a surface of the container to prevent ejection of the insert from the aperture.

9. The kit of parts defined in claim 6, in which the resilient radial projection comprises a flange having a non-round outer edge.

10. The kit of parts defined in claim 6, in which the projection comprises a surface which extends forwardly and outwardly in the insertion direction.

11. The kit of parts defined in claim 10, in which an annular boss is provided at the base of the flange.

12. In combination:

an insert comprising an internally threaded, through-going opening adapted to receive a complementary, externally threaded plug to form a fluid-tight sealed closure;

a container wall having an aperture therein;

the insert comprising an external circumferential groove for snap-fittingly retaining the insert installed in the aperture; and an annular sealing element receivable in the circumferential groove so as to form a peripheral, fluid-tight seal between the insert and the aperture;

the insert further comprising an end which, prior to installation of the insert in the container aperture, is formed with:

(i) a tapered rim which provides a guide surface for leading the insert through the container aperture under compression, and (ii) a rearwardly facing shoulder shaped to snap-fittingly retain the insert in the container aperture when installed therein;

wherein the insert is configured such that during installation of the insert in the container aperture, compression of the rim will distort the groove so as to open up a space between the groove and the container opening until the rearwardly facing shoulder snap-fittingly retains the insert installed in the container aperture.

13. The combination defined in claim 12, in which the circumferential groove comprises a cross-section that is elongated in the axial direction of the insert thread; and an edge portion of the container aperture which is formed as an upstanding collar being received in the groove, thereby defining between the collar and the groove a gland area within which the annular sealing element is receivable.

14. The combination defined in claim 13, in which, while the insert is being installed in the aperture, the insert and/or the collar is/are resiliently deformed and the sealing element is carried by the circumferential groove into the collar with no or reduced compression;

the collar snapping behind the rearwardly facing shoulder when the insert is fully installed; the insert and/or the collar thereby resiliently recovering and compressing the sealing element.

15. The combination defined in claim 14, in which the rearwardly facing shoulder forms a forward end wall of the circumferential groove.

16. The combination defined in claim 13 in which the upstanding collar is tapered so as to narrow in a direction along which the insert is installed.

17. A method of snap-fittingly installing an insert in an aperture in a container wall, the insert comprising an external circumferential groove; an internally threaded, through-going opening adapted to receive a complementary, externally threaded plug to form a fluid-tight sealed closure; and an end forming a tapered rim which, prior to installation of the insert in the container aperture, provides:

(i) a guide surface and (ii) a rearwardly facing shoulder;

an edge portion of the container aperture being formed as an upstanding collar;

the method comprising the steps of:

installing a sealing element in the circumferential groove;

pressing the insert into the collar so that the guide surface resiliently deforms the insert and/or the collar and the sealing element is carried into the collar under reduced or no compression, and further pressing the insert into the collar so as to allow a forward end of the collar to snap fit into place behind the rearwardly facing shoulder;

the insert and/or the collar thereby resiliently recovering so as to compress the sealing element between the circumferential groove and the upstanding collar.

18. The method of claim 17, further comprising: pressing the insert into the collar until a clearance is developed between the forward end of the collar and the rearwardly facing shoulder; the insert further comprising a resilient portion which is deformed and pre-loaded against a surface of the container wall as the insert is pressed into the collar, and ceasing to press the insert into the collar, whereupon the resilient portion pulls the forward end of the collar into engagement with the rearwardly facing shoulder.

* * * * *